United States Patent [19]

Stokes et al.

[11] Patent Number: 4,481,407

[45] Date of Patent: Nov. 6, 1984

[54] ELECTRIC HOTPLATE

[75] Inventors: Paul W. Stokes, Ringwood; Brian C. Doody, Camberwell; Harold K. Lill, Thomastown, all of Australia

[73] Assignee: Stokes (Australasia) Limited, Ringwood, Australia

[21] Appl. No.: 262,505

[22] Filed: May 11, 1981

[30] Foreign Application Priority Data

May 12, 1980 [AU] Australia ..... PE3502

[51] Int. Cl.[3] ..... H05B 3/68

[52] U.S. Cl. ..... 219/457; 219/462; 219/464; 219/467; 219/540; 338/22 R; 338/230; 425/78

[58] Field of Search ..... 219/363, 449, 457, 462, 219/463, 469, 464, 540; 425/78; 264/111; 29/194, 611, 613, 614, 615; 338/22 R, 230; 174/126

[56] References Cited

U.S. PATENT DOCUMENTS

| | | | |
|---|---|---|---|
| 1,974,302 | 9/1934 | Finlayson | 219/538 |
| 2,359,983 | 10/1944 | Fry | 219/457 X |
| 2,851,572 | 9/1958 | Steck | 219/457 |
| 2,888,715 | 6/1959 | Frank | 264/111 |
| 3,067,311 | 12/1962 | Lacy-Hulbert | 219/449 X |
| 3,110,795 | 11/1963 | Bremer | 219/457 |
| 3,132,229 | 5/1964 | Bremer et al. | 219/448 |
| 3,214,568 | 10/1965 | Bremer | 219/463 |
| 3,349,224 | 10/1967 | Jaeger | 219/540 |
| 3,436,816 | 4/1969 | Lemelson | 29/611 |
| 3,520,043 | 7/1970 | Darling | 219/363 X |
| 3,723,589 | 3/1973 | Kennedy | 264/111 X |
| 3,758,750 | 9/1973 | Van Toorn | 219/457 |
| 3,885,128 | 5/1975 | Dills | 219/462 |
| 4,018,861 | 4/1977 | Bierwith | 264/111 X |

FOREIGN PATENT DOCUMENTS

| | | | |
|---|---|---|---|
| 497871 | 12/1938 | United Kingdom | 219/457 |
| 504637 | 4/1939 | United Kingdom | 219/457 |
| 1002849 | 9/1965 | United Kingdom | 219/457 |

*Primary Examiner*—Volodymyr Y. Mayewsky
*Attorney, Agent, or Firm*—Armstrong, Nikaido, Marmelstein & Kubovcik

[57] ABSTRACT

An electric hotplate formed by taking a heating element comprising an unsheathed resistance wire which exhibits a substantial increase in resistivity within an increase in temperature thereof; an insulating material around the wire and a casing enclosing the wire; and insulating material, locating said element in a mass of metal powder, compressing the solid mass to form a body containing said element, and heat treating the body to cause bonding between the powder particles and to form an electrical hotplate having said element embedded therein.

25 Claims, 16 Drawing Figures

ELECTRIC HOTPLATE

This invention relates to heating.

In one aspect this invention relates to electric hotplates for stoves.

The well known radiant coil hotplate has certain disadvantages among which are the need to provide a splash tray and difficulty of cleaning; however, it is electrically efficient. A new hotplate which is of cast iron and which has an electric resistance wire heater element embedded in a matrix in a groove on the underside is easy to clean and needs no splash plate; however, it is electrically inefficient, it transfers heat to a pot or pan less efficiently than does a radiant coil, it is often not as flat as is desired, it is expensive to make and its life is not as high as that of a radiant coil.

The present invention provides an electric hotplate formed by taking a heating element comprising an unsheathed resistance wire, which exhibits a substantial increase in resistivity with an increase in temperature thereof, an insulating material around the wire and a casing enclosing the wire and insulating material; locating said element in a mass of metal powder, compressing said mass to form a body containing said element, and heat-treating said body to cause bonding between the powder particles and to form an electric hotplate having said element embedded therein.

U.S. Pat. No. 3,520,043, discloses a sheathed resistance wire which has a resistance which is temperature dependent.

However, in the process of our experiments with the techniques of U.S. Pat. No. 3,520,043, we have found it difficult to obtain the specified resistance wire and instead, used a mild steel resistance wire, arguing to ourselves, that while it would have a short life and other problems as U.S. Pat. No. 3,520,043 indicated, at least we would be able to prove to disprove the ability of the hotplate to self-control.

To our surprise, we not only found adequate self-control, but also found a quite satisfactory life, even under accelerated aging conditions.

Accordingly, we have found that while the special sheathed wire may be needed in the context of U.S. Pat. No. 3,520,043, in the hotplates of the present invention no special wire is required.

We attribute part of the satisfactory life to the protection given to the wire by the body of the present invention.

The present invention provides in a first preferred aspect a method of making an electric hotplate comprising locating an electric heating element in a mass of metal powder, compressing said mass to form a body containing said element, and heat treating said body to cause bonding between the powder particles and to form an electric hotplate having said element embedded therein.

A number of metals and alloys may be used as said powder. Among them are iron, steels and copper containing alloys. Desirable characteristics of the metal or alloy are cheapness, resistance to corrosion when used as a hotplate, non-tarnishing and good heat conductance. At the present time it is preferred to use substantially pure iron. However, copper may be incorporated.

Said powder may include a lubricant such as zinc stearate as this will aid the compressing step and may reduce excessive work hardening in the compressing step.

Said powder if substantially pure iron will usually have a powder density of about 2.8 gm/cc and in the compressing step it is preferably pressed to a density of not less than 6.0 gm/cc with 6.3 gm/cc being more preferred. In this respect, it may be noted that the specific gravity of iron is 7.8. In some instances, where voids between powder particles are to be subsequently filled, pressing to a density of 5.9–6.0 gm/cc may be satisfactory. In general, pressing to at least 70% of theoretical density may be done but at least 80% is more preferred.

The amount of pressure to be applied in the compressing step will vary in accordance with the powder being used but 18 to 28 tons/square inch will usually be found to be satisfactory.

The embedding of said element may cause difficulty in the compressing step in that the powder may be pressed to a greater density in the region of said element as compared to in other regions and this may damage presses or tooling in the pressing or lead to a hotplate having weaknesses. This problem can be at least partly overcome by forming the body to have a ridge or ridges in the region of said element; in this respect, the size of the ridge or ridges is chosen so that said body will have a similar density in the region of the element and in other regions. This problem can also be at least in part overcome by the use of appropriate tooling.

In this last respect, tooling for pressing said mass to form said body may have differentially movable parts to result in substantially even density of said powder throughout said body.

In one preferred instance the element was provided with supports to support it a predetermined distance above a die and so that either a top surface of the element or the centre of the element was located in a central plane of the powder particles because, in that plane the particles can be considered to be in a neutral plane and not to move in the compressing. Further, the tooling was so shaped that the thickness of said body in the region of the element less the thickness of said element was substantially the same as in regions remote from the element. In one instance, supports were provided by transverse lengths of wire. In another instance small mounds of powder were placed to support the element.

Said element may be wholly embedded in said body or may be flush with a surface thereof or may even project from said body.

Said heat treating is carried out for a time and a temperature to cause bonding (sintering) between the powder particles. In general, if said powder is iron, heating for at least 30 minutes to at least 1100° C. is desirable. Said heat treating is preferably carried out in an endothermic atmosphere furnace although an exothermic atmosphere furnace can be used. However, whether an endothermic or exothermic atmosphere furnace is used depends on the nature of said powder and whether one wants to carburize or de-carburize the mass of material.

The hotplate formed from said heat treating will have voids between the powder particles. Those voids can be substantially reduced if the hotplate is subjected to a subsequent void filling operation such as heating in the presence of steam such as for 45 minutes at 580°–620° C. to cause magnetite formation or heating in the presence of a metal such as copper which will flow into the hotplate to fill voids or dipping the hotplate in molten metal such as copper to fill voids.

It is also possible in said heat treating to put an amount of copper on said body to be melted and fill voids to produce about 100% density. The amount of copper to be used can be found by calculating the voids from a knowledge of the density of said body.

It is particularly desirable that voids in the hotplate should be filled with copper as both of these are good conductors of heat.

Said element preferably comprises a resistance wire within a tube and separated from the tube by an insulator such as magnesium oxide. Terminals for the resistance wire are provided outside of the tube.

The material of the tube may bond to the powder particles and this is desirable. Mild steel or bundyweld is the preferred, material for this operation. In the case of bundyweld there is a copper coating and this seems to migrate within the hotplate.

Further, a bolt for securing the hotplate to a hob will usually be desired. This may be provided by providing a hole in the body which can be tapped to receive a bolt or stud. That hole may be a blind hole. Alternatively, a boss to which a bolt or stud may be welded may be provided or a bolt or stud may be direct welded.

It will be usual to provide a coverplate under the hotplate to protect exterior electric wiring from heat.

A slight concavity in the centre of the hotplate should help to reduce distortion resulting from heating. A bolt head might locate in such a concavity.

Painting of the hotplate with a corrosion and heat resistant paint is desirable. Such a paint may cover the element if it is exposed and if adequately protective may permit use of elements with mild steel casings.

The provision of terminals for said element may produce difficulty in respect of the first aspect of this invention in that pressing powder while maintaining element terminals outside of the powder mass is difficult, sealing problems may occur and difficulty in removal from, and making of, dies may be found.

Accordingly, it is now preferred that the entirety of the element and any terminals thereof be embedded in said body and that after the pressing (but not necessarily after the heat treatment) said body should be opened in a region to free part or ends of the element and/or terminals. Opening of the body can be done by cutting, grinding or in any other convenient way.

In one specific instance an element comprising a resistance wire surrounded by insulating powder and which powder was surrounded by a sheath also included terminals which were located within the sheath. The entirety of that element was embedded in said body and after pressing the body and sheath were cut to expose the terminals which were then bent out of the body.

In another instance, terminals were sheathed by copper or plastic and in the heat treatment the copper or plastic melted and dispersed through said body or burnt off to leave a cavity in said body in the region of the terminals. Opening of said body in the region of the terminals revealed the terminals which were then bent out of the body.

Said body may be formed to have a visually discernable appearance in the region in which ends of the element or terminals are located so that a person desiring to open said body will know the correct place to do so. Such an appearance can be provided by a bump or depression formed during the pressing. In one instance a plastic sheath over the terminals was arranged to be visible after pressing.

The above described techniques have been applied by us most successfully to produce a hotplate requiring no machining of its pot contacting surface and of lower mass and hence lower thermal inertia than a cast iron hotplate. Further, heat conduction from the element to a pan seems to be better perhaps as a result of no matrix being needed as in the cast iron hot plate.

It is preferred that hotplates in accordance with this invention should run at a maximum temperature of 700° C. with 650° C. being more preferred and 600° C. being most preferred.

Accordingly, it is preferred that the surface area of the hotplate and its heat dissipatory character and the wire has a resistivity such that the hotplate will come to thermal stability at a temperature of not more than 700° C., preferably not more than 650° C. and preferably not more than 600° C. when installed and in use in an electric cooker. The hotplate is preferably able to dissipate at least 15 kw/$M^2$.

The wire preferably exhibits an at least three times increase in resistance between 25° C. and 700° C., more preferably at least four times increase between 25° C. and 600° C.

In the preparation of a 145 mm diameter hotplate designed to dissipate 720 watts and to be stable at 600° C. in use we used a mild steel wire of 0.0126 inch (28 B & S gauge) wound into a helix of 0.104 inch outside diameter. The wire had a resistivity of 0.7891 ohms per foot at 20° C. A length of that helix having a resistance of 22 ohms at 20° C. and having terminals was inserted into a bundyweld tube which was filled with magnesium oxide and rolled to compact the tube and magnesium oxide about the wire. As a result of such working the resistance of the wire fell to 16.6 ohms at 20° C. The tube was then formed into a spiral in a die and embedded into metal powder which was compressed and heat treated. The resultant hotplate had a resistance of 80 ohms at 600° C. which is 4.819 times the cold resistance.

In the case of a 180 mm hotplate the same wire but of 0.016 diameter in helical form of 0.104 inch outside diameter was used as a length having a resistance of 16.7 ohms at 20° C. After working into a tube with magnesium oxide it had a resistance of 12.45 ohms at 20° C. The hotplate dissipated 960 watts at 600° C. where thermal stability was met with the wire having a resistance of 60 ohms.

As a result of changing wire diameters we have found that resistance wire diameter is an important consideration in that if relatively thin wire is used the wire itself may run hotter even though the hotplate itself remains at 600° C. In this last respect, examination of graphs of temperature co-efficient of resistance vs. temperature commonly show a decrease of slope, i.e., a shoulder above 700° C. and thus it is preferred that the wire be of such diameter that the temperature of the wire per se will not result in the wire being substantially on the shoulder of the curve of temperature co-efficient of resistance vs. temperature at its designed maximum operating temperature.

Thus, in respect of the mild steel wire used in the 145 mm hotplate a diameter of 0.012–0.013 inch is preferred. In the case of the 180 mm hotplate a wire diameter of 0.015–0.0165 inch is preferred.

The present invention will now be illustrated with the aid of the accompanying drawings in which:

DETAILED DESCRIPTION OF THE DRAWINGS

Figure 1:
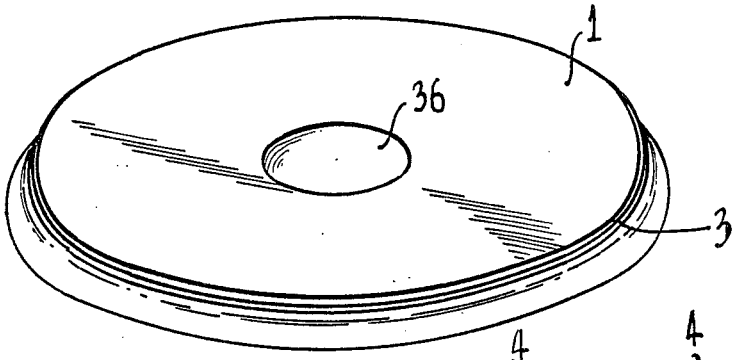
FIG. 1 is a top perspective view of a first hotplate.
Figure 3:
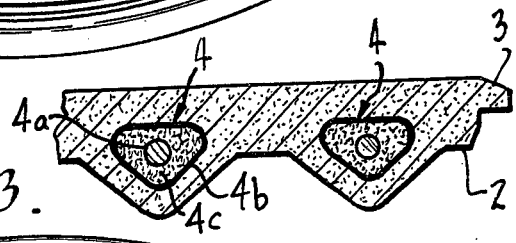
FIG. 3 is a fragmentary cross-section through the first hotplate.
Figure 2:
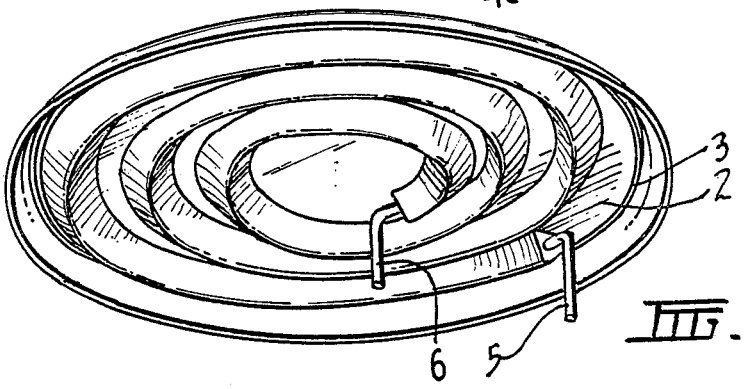
FIG. 2 is a bottom perspective view of the first hotplate.

The hotplate shown in FIGS. 1-3, which is made by pressing and heating metal powder, comprises a smooth top surface 1 and a ribbed bottom surface 2, a peripheal flange 3 and has an electrical heating element 4 embedded therein. The element 4 comprises a resistance wire 4*a* within a tube or sheath 4*b*, and separated from the tube or sheath by an insulator 4*c*, such as magnesium oxide. The element 4 has terminals 5 and 6.

Figure 4:
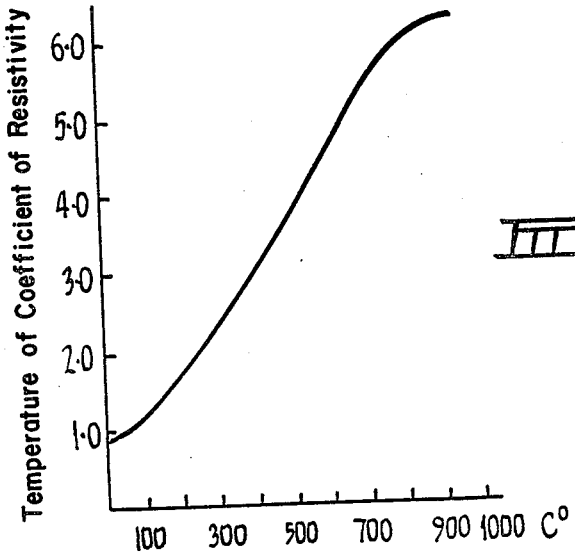
FIG. 4 is a graph of temperature co-efficient of resistivity (y-co-ordinate) against temperature (x-co-ordinate) for mild steel wire.

The graph of FIG. 4 shows temperature coefficient of resistivity against temperature of a resistance wire and it should be noted that it is preferred to use resistance wire under such conditions that its temperature is always below the shoulder region of the graph.

The hotplate shown in FIGS. 1-3 was made by pressing metal powder is a 700 ton press using tooling comprising a generally smooth top punch, a perimetric die and a grooved bottom punch. The top punch and die were moved downwardly and the bottom punch was also movable downwardly to compensate in the region of the flange 3 and the region where the element is located.

After the pressing the hotplate was subjected to heat treatment as described below.

In the pressing step the iron powder used was compressed to densities of from 5.9 to 6.3 gm/cc.

In the heat treating, various techniques for different hotplates were used being:

(a) heating in a furnace at 1100° C. for 30 minutes followed by steam treatment for 45 minutes at 580°-620° C., (b) heating in a furnace at 1100° C. for 30 minutes with copper so as to infiltrate copper in to voids, and (c) heating in a furnace for 30 minutes at 1100° C. followed by immersion in to molten copper to infiltrate voids.

Figure 5:
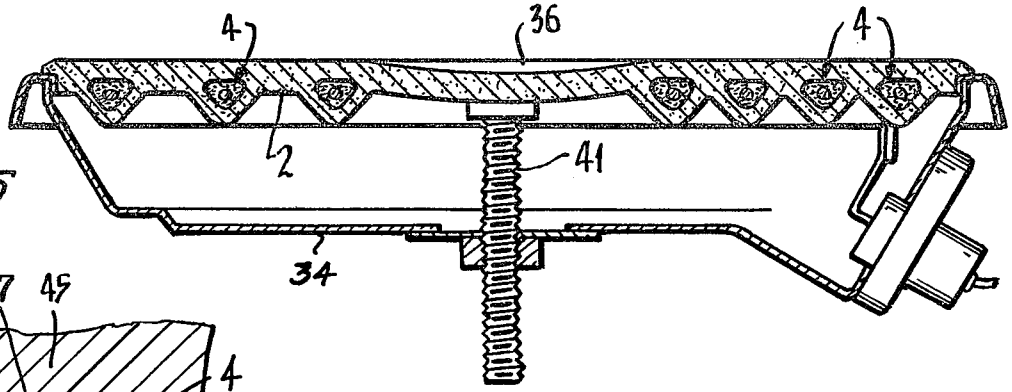
FIG. 5 is a cross-sectional view through a second hotplate.

The second hotplate of FIG. 5 is similar to that of FIG. 1, but has a lip 32 for engagement with an edge 33 of hob 34, and is dished at 36 and has a stud 41. Further, this underside shows ridges within which the element 4 is located.

Figure 6:
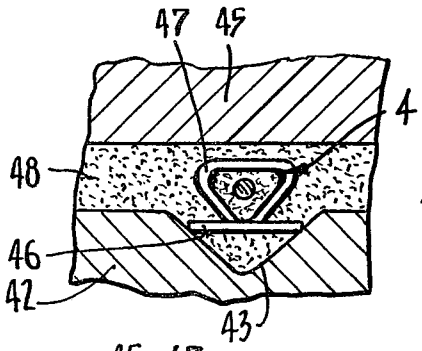
FIG. 6 is a cross-sectional view showing a stage in the manufacture of the second hotplate.
Figure 7:
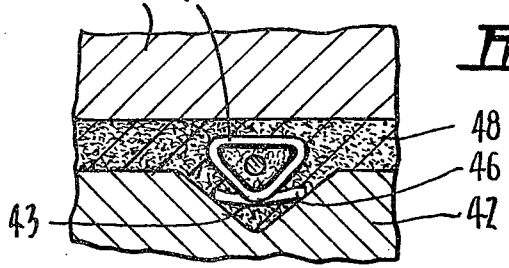
FIG. 7 is a cross-sectional view showing another stage in the manufacture of the second hotplate.

In making the hotplate of FIG. 6 a bottom die 42 was used having a groove 43 and the element 4 was provided with support wires 46, 47 to support it above the die 42 with its upper surface on a neutral line of a powder fill 48. Element 4 comprises a resistance wire 4*a* within a tube or sheath 4*b*, and separated from the tube or sheath by an insulator 4*c*, such as magnesium oxide. It is to be observed that the groove 43 and depth of powder fill was arranged such that the powder fill was substantially of even depth if the thickness of the element 4 is subtracted. Thus, using about a 2.1:1 compaction ratio with a top punch 45 the powder fill 48 was pressed to have substantially even density throughout the hotplate including and comparing regions where the element 4 was located and regions remote from the element 4. In the pressing step the wires 46 were bent as shown in FIG. 7. Heat treatment as above was also applied to sinter the powder.

Figure 8:
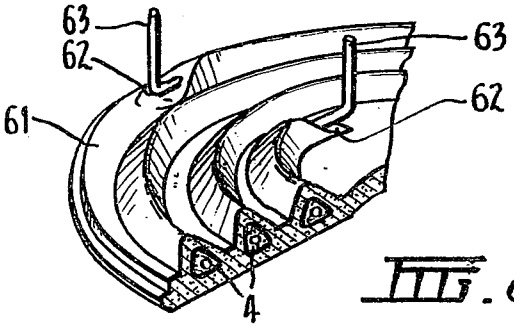
FIG. 8 is a perspective view of the underside of yet another hotplate.

The hotplate 61 shown in FIG. 8 was formed similarly as that of FIG. 1 but an element 62 having terminals 63 was entirely embedded and later was opened by machining to reveal the terminals 63 which were then bent out from the hotplate.

Hotplates made as described above have lower thermal inertia greater electrical and heat efficiency, more regular surfaces and lower mass as compared to some prior art hotplates.

In making hotplates in accordance with this invention we have striven to ensure even powder density exists after the compressing step. However, we have had to accept that some unevenness of density would result. Indeed, in making hotplates using substantially pure iron by the techniques described with respect to FIGS. 6 and 7 we found some samples to have densities above the element of 6.2 gm/cc and higher and to the sides of the element of about 5.8 gm/cc. Rather than this being undesirable, it has turned out that the higher density in the region element and the lower density to the sides of the element is positively beneficial in that heat is conducted better between the element and the top of the hotplate (the pot contacting surface of the hotplate) and this results in the hotplate being more responsive to the temperature of the pot. Thus, we now recommend that the compressing be conducted to achieve a higher density in the region of the element than remote from the element. However, if other metals are included in the powder in large quantities and which have different rates of expansion to pure iron, difficulty may be found in the heat treatment as a result of differential expansion. Thus, where density differences are desired the use of substantially pure powders is recommended.

Figure 9:
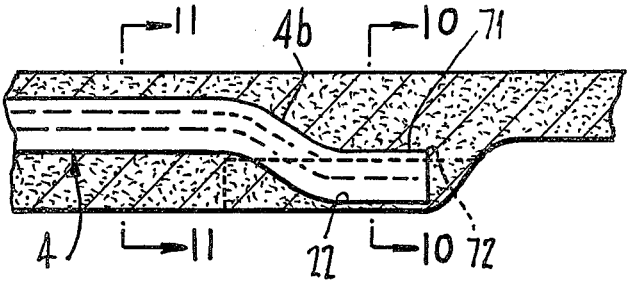
FIG. 9 is a cross-sectional view through a compressed hot plate.
Figure 10:
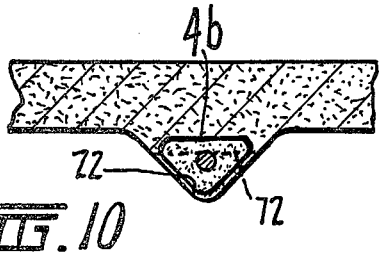
FIG. 10 is a cross-section on line 10—10 in FIG. 9.
Figure 11:
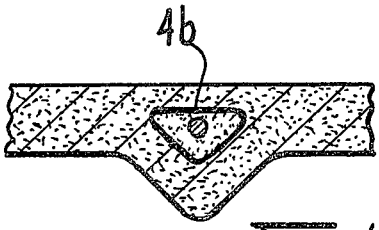
FIG. 11 is a cross-section on line 11—11 in FIG. 9.

Referring now to FIGS. 9-11, an end 71 of the element 4 was cranked so that its surface 22 was adjacent the bottom forming die. Thus, after compressing it was only necessary to remove part of the compressed metal powder and to open the sheath 46 as shown by dash line 72 to expose the end of the resistance wire or a terminal therefor. Further, the cranked end served as a support for the element above the bottom forming die.

Figure 12:
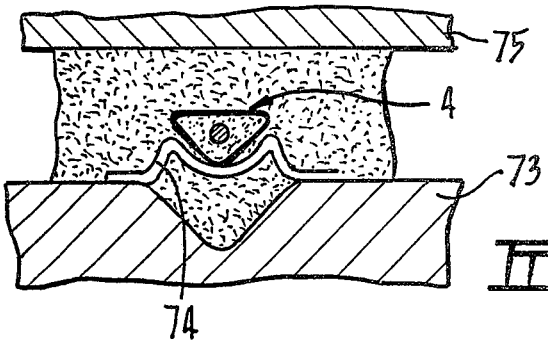
FIG. 12 is a cross-section of a tool means forming a hotplate.
Figure 13:
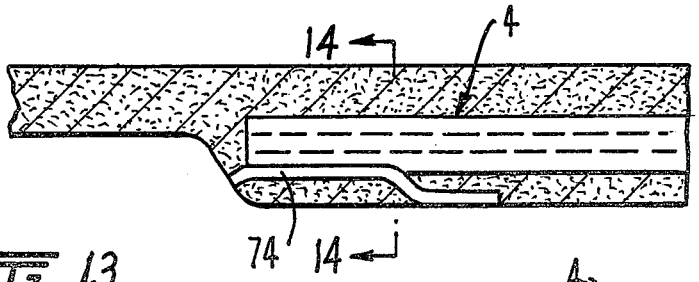
FIG. 13 is a cross-sectional view through a hotplate formed as in FIG. 12.
Figure 14:
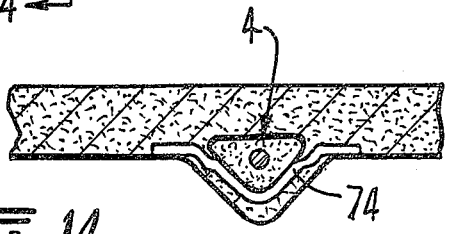
FIG. 14 is a cross-section on line 14—14 in FIG. 13.

Referring now to FIGS. 12-14, an element 4 was supported above powder and a bottom forming die 73 by a plastic form 74 and further powder was applied (see FIG. 12). After compressing with a top forming die 75 the result was as shown in FIGS. 13 and 14. It should be noted that the plastic form 74 was sufficiently close to the bottom of the hotplate so formed to be easily prised out to expose the end of the element 4.

Figure 15:
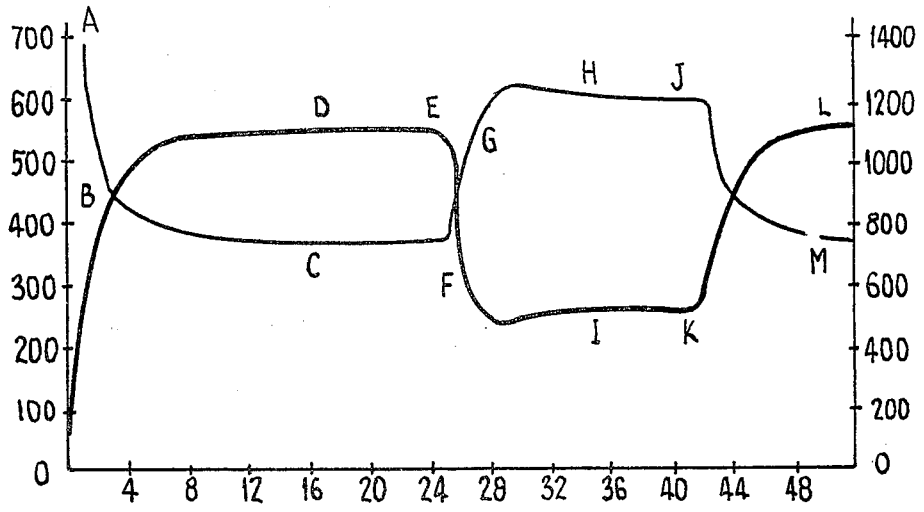
FIG. 15 is a graph with respect to a cast hotplate with time and minutes on the x-access, temperature at the outer edge in degree C on the left x-access and watts at 240 V on the right y-access.
Figure 16:
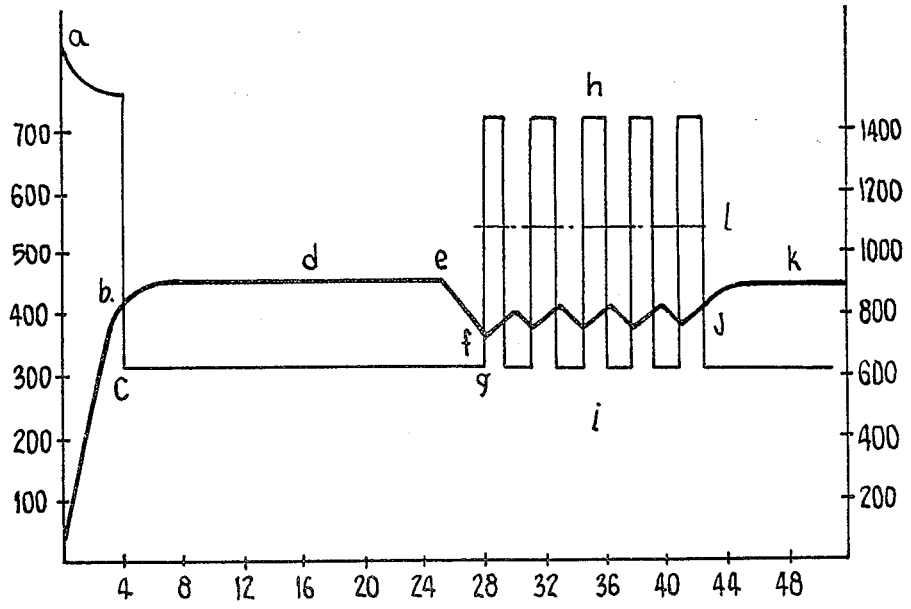
FIG. 16 is a similar graph to FIG. 15, but with respect to a hotplate of the present invention.

Concerning performance of a hotplate in accordance with this invention relative to a known cast hotplate reference is made to the accompanying drawings in which:

FIG. 15 is a graph in respect of the cast hotplate with time in minutes on the x-axis, temperature at outer edge in ° C. on the left y-axis and watts at 240 Volts on the right y-axis, and FIG. 16 is a similar graph to FIG. 15 but in respect of the hotplate of the present invention.

The cast hotplate was 145 mm in diameter and rated at 1500 W 240 V. It was provided with two resistance heating wires one of which was controlled by a heat sensing switch mounted below the cast hotplate.

The hotplate of the present invention was 145 mm in diameter, had a single resistance wire worked to a resistance of 16.6 ohms at 20° C. and 80 ohms at 600° C. The hotplate had a surface area of 43184.8 sq mm and heat dissipatory characteristics of 17.067 $Kw/M^2$. No heat sensing switch was used.

The graphs illustrate temperature at the edge of the hotplates and power with respect to time from switch on, through stabilization for 25 minutes whereafter pots containing 1.5 liters of water were placed on the hotplates and the graphs continued thereafter.

The following points of interest from the cast hotplate graph are noted:

(a) initial power off scale due to sudden current in rush at peak demand,
(b) temperature has risen and actuates a switch to shut off one resistance wire,
(c) as a result power falls, and
(d) temperature stabilizes;
(e) vessel placed on cast hotplate,
(f) as a result temperature falls until
(g) switch activates said one resistance wire,
(h) switch opens and closes,
(i) temperature fluctuates,
(j) pot removed,
(k) temperature and power again stabilizes,
(l) average load 1080 watts.

The following points of interest from the hotplate of the invention graph are noted:

(A) initial power off scale due to sudden current in rush at peak demand,
(B) temperature has risen and resistance of wire increases,
(C) as a result, power falls, and
(D) temperature stabilizes;
(E) vessel placed on hotplate,
(F) as a result temperature falls, and
(G) power increases, until
(H) stability of power, and
(I) stability of temperature again reached with
(J) power consumption about 1200 watts
(K) pot removal,
(L) temperature stabilizes, and
(M) power stabilizes.

Modifications and adaptations may be made to the above described without departing from the spirit and scope of this invention which includes every novel feature and combination of features disclosed herein.

The claims form part of the disclosure of this specification.

We claim:

1. An electric hotplate formed by taking a heating element comprising an unsheathed resistance wire which exhibits a substantial increase in resistivity with increase in temperature thereof, an insulating material around the wire and a metal casing enclosing the wire and insulating material, locating said element in a mass of metal powder, compressing said mass to form a body containing said element, and heat treating said body in a furnace at 1100° C. for 30 minutes, followed by steam-treating for 45 minutes at 580°–620° C., to form an electric hot plate having said element embedded therein.

2. An electric hotplate formed by taking a heating element comprising an unsheathed resistance wire which exhibits a substantial increase in resistivity with increase in temperature thereof, an insulating material around the wire and a metal casing enclosing the wire and insulating material, locating said element in a mass of metal powder, compressing said mass to form a body containing said element, and heat-treating said body by heating in a furnace at 1100° C. for 30 minutes with copper, thereby infiltrating copper into voids in the mass of metal powder, so as to form an electric hotplate having said element embedded therein.

3. An electric hotplate formed by taking a heating element comprising an unsheathed resistance wire which exhibits a substantial increase in resistivity with increase in temperature thereof, an insulating material around the wire and a metal casing enclosing the wire and insulating material, locating said element in a mass of metal powder, compressing said mass to form a body containing said element, and heat-treating said body by heating in a furnace at 1100° C. for 30 minutes, followed by immersion in a molten copper, thereby infiltrating copper into voids in the mass of metal powder, so as to form an electric hotplate having said element embedded therein.

4. An electric hotplate formed by taking a heating element comprising an unsheathed resistance wire, an insulating particulate material around the wire and a metal casing enclosing the wire and said insulating particulate material; locating said element in a mass of metal powder; compressing said mass and said insulating particulate material under a pressure of at least 18 tons per square inch to form a compacted body containing said element and to compact said insulating particulate material about said resistance wire, and heat treating said body to cause bonding between the power particles and to form an electric hotplate having said element embedded therein; wherein said resistance wire exhibits a substantial increase in resistivity with increase in temperature thereof and exhibits a temperature co-efficient of resistance vs. temperature graph having a decrease of slope with a shoulder at an elevated temperature, and wherein said resistance wire is of a diameter and the hotplate has a surface area and heat dissipatory characteristics such that, in use, the temperature of said resistance wire per se, when the hotplate is at the designed maximum operating temperature of greater than 500° C., will not result in the wire being substantially on the shoulder of the curve of temperature co-efficient of resistance vs. temperature.

5. An electric hotplate as claimed in claim 4, wherein said resistance wire is selected from the group consisting of iron, an iron alloy and a nickel-iron alloy.

6. An electric hotplate as claimed in claim 4, wherein said resistance wire is of mild steel.

7. An electric hotplate as claimed in claim 4, wherein the hotplate has a surface area and heat dissipatory characteristics and said resistance wire has a resistivity such that the hotplate will come to thermal stability at a temperature of not greater than 650° C. when installed and in use in an electric cooker.

8. An electric hotplate as claimed in claim 4, wherein the hotplate has a diameter of about 145 mm, said resistance wire is of mild steel and has a diameter of 0.012–0.013 inch.

9. An electric hotplate as claimed in claim 4, wherein the hotplate has a diameter of about 180 mm, said resistance wire is of mild steel and has a diameter of 0.015–0.0165 inch.

10. An electric hotplate as claimed in claim 4, wherein the wire has a resistivity per foot within the range 0.7±15% ohms at 20° C. and 2.7–3.7 ohms at 600° C.

11. An electric hotplate as claimed in claim 4, wherein the wire exhibits an at least 3 times increase in resistance between 25° C. and 600° C.

12. An electric hotplate as claimed in claim 4, wherein said body has a substantially smooth upper surface and at least one ridge on an undersurface within which said element is located.

13. An electric hotplate as claimed in claim 4, wherein the compressing was carried out to achieve a density of said body at least equal to at least 70% of the specific gravity of said metal.

14. An electric hotplate as claimed in claim 4, wherein the metal powder is substantially pure iron.

15. An electric hotplate as claimed in claim 4, wherein the compressing was carried out such that said body had a density of at least 5.9 gm/cc.

16. An electric hotplate as claimed in claim 4, wherein said body was subjected to a void filling step.

17. An electric hotplate as claimed in claim 16, wherein the void filling was achieved by steam treating.

18. An electric hotplate as claimed in claim 16, wherein the void filling was achieved by diffusing metal through the body during said heat treating.

19. An electric hotplate as claimed in claim 4, wherein said hotplate was formed by at least substantially entirely embedding said element and terminals thereof in said body and, after pressing, opening said body in a region to free part of said element and terminals.

20. An electric hotplate as claimed in claim 4, wherein the pressing and heat treating were conducted such as to cause bonding of the casing and the powder particles.

21. An electric hotplate as claimed in claim 19, wherein said opening was performed prior to said heat treating.

22. An electric hotplate as claimed in claim 19, wherein said element has terminals and wherein said terminals are surrounded by a material which, when removed, will leave a depression in which the terminals are located.

23. An electric hotplate as claimed in claim 4, wherein the heat treating is conducted in a furnace at 1100° C. for 30 minutes, followed by steam treating for 45 minutes at 580°–620° C.

24. An electric hotplate as claimed in claim 4, wherein the heat treating is conducted by heating in a furnace at 1100° C. for 30 minutes with copper, thereby infiltrating copper into voids in the mass of metal powder.

25. An electric hotplate as claimed in claim 4, wherein the heat treating is conducted by heating in a furnace at 1100° C. for 30 minutes, followed by immersion in molten copper, thereby infiltrating copper into voids in the mass of metal powder.

* * * * *